United States Patent [19]

Sedlak et al.

[11] 4,192,132

[45] Mar. 11, 1980

[54] QUARTZ CONTROLLED ANALOG WATCH

[75] Inventors: Adolf Sedlak, Wurmberg-Neubaerental; Horst Friedrich, Pforzheim, both of Fed. Rep. of Germany

[73] Assignee: Timex Corporation, Waterbury, Conn.

[21] Appl. No.: 40,623

[22] Filed: May 21, 1979

[30] Foreign Application Priority Data

Jun. 24, 1978 [DE] Fed. Rep. of Germany ..... 2827790

[51] Int. Cl.[2] ..... G04C 3/04

[52] U.S. Cl. ..... 368/160; 368/217

[58] Field of Search ..... 58/23 D, 23 R, 28 R, 58/28 B, 28 A

[56] References Cited

U.S. PATENT DOCUMENTS 4,128,992 12/1978 Egger et al. ..... 58/23 D

FOREIGN PATENT DOCUMENTS 1540555 2/1979 United Kingdom ..... 58/23 D

*Primary Examiner*—Gene Z. Rubinson
*Assistant Examiner*—John B. Conklin
*Attorney, Agent, or Firm*—William C. Crutcher

[57] ABSTRACT

A quartz controlled analog watch with a minute hand indexed once a minute by minute pulses and a seconds hand indexed once every five seconds by weaker pulses occurring at five second intervals between minute pulses.

5 Claims, 4 Drawing Figures

QUARTZ CONTROLLED ANALOG WATCH

BACKGROUND OF THE INVENTION

The invention relates to a quartz controlled analog watch having a quartz controlled pulse generator for delivering minute pulses and an indexing means mounted for rotation about an axis and for directly driving a minute wheel through the intermediary of an indexing device, said indexing means being adapted to be deflected from a position of rest by means of a coil to which output pulses from the pulse generator have been applied, and a permanent magnet, one of which is stationarily mounted and the other on the indexing means, and to be returned by a return spring.

Such a watch is described in German Offenlegungsschrift No. 2,617,077 and U.S. Pat. No. 4,128,992 issued Dec. 12, 1978 to Egger et al, both belonging to the Applicants' assignee, and the disclosure of these publications is incorporated herein by reference. In this known watch, the smallest unit indicated is the minute, which is the reason why the indexing means directly drives a minute wheel. The watch has the advantage of being extremely simple and robust in its design, and at the same time highly accurate in its indication.

The object underlying the invention was to provide such a watch with a second hand, and yet involving lower cost than in the known watches where the second wheel drives the minute wheel by way of an intermediate drive. Starting with a quartz controlled analog watch of the kind mentioned at the beginning, this object is attained in accordance with the invention in that the pulse generator is designed to deliver minute pulses and other time pulses weaker in energy than the minute pulses, the pulse series frequency of said other time pulses being 1/n Hz and n an integer less than 60, so that the indexing means can be deflected by said other time pulses from its position of rest to a first indexing position and beyond that by the minute pulses to a second indexing position; in that a second wheel adapted to be driven by the indexing means through the intermediary of the indexing device is provided; and in that the indexing device, the minute wheel and the second wheel are so designed and mounted in relation to one another that the second wheel is indexable by way of deflection of the indexing means to its first indexing position, while the minute wheel is only indexable by way of greater deflection of the indexing means to its second indexing position. Accordingly, in the watch according to the invention, one and the same component directly (through the intermediary of the indexing device consisting, for example, of a pawl) drives both the second and the minute wheel so that the otherwise customary gear between the second wheel and the minute wheel and the bearings required therefor can be eliminated. The movement of the watch is thereby rendered not only simpler and less expensive in its manufacture, but also compacter in its design. Moreover, the provision of an output at the frequency divider contained in the pulse generator for delivering the other time pulses weaker in energy invovles no greater expenditure as far as both costs and space requirement are concerned.

Since in many cases where the second hand of a watch is read, it would be quite sufficient for it to be indexed, for example, in five-second-jumps, the other time pulses of weaker energy in a preferred embodiment of the analog watch according to the invention have a pulse series frequency of less than 1 Hz, and, more particularly, a frequency of 1/5 Hz (n is then equal to 5). Accordingly, the second wheel does not have 60, but rather only 60/n teeth, and therefore in the case of the preferred embodiment only 12 teeth. The decrease in the pulse series to below 1 Hz has the additional advantage that the energy requirement of the watch according to the invention is substantially less than in a watch in which 60 pulses per minute must be delivered to drive the second hand. This is, of course, particularly important in battery driven watches, to which the invention preferably relates. From the aforesaid, it is apparent that the term "second wheel" is not to be interpreted as a wheel which is by all means indexed each second, but rather as a wheel which drives the second hand.

SUMMARY OF THE INVENTION

Briefly stated, the invention comprises the improvement in a quartz controlled analog watch with an indexing means having a coil actuated by pulses for a pulse generator, circuit means providing minute pulses and other time pulses weaker in energy than the minute pulses, means coupling the pulses to the coil to deflect the indexing to the first and second indexing positions, means a second wheel indexed by the indexing means at the first position and a minute wheel indexed only when the indexing means moves to the second position.

A simple embodiment of the indexing device is obtained if the latter comprises one pawl mounted on the indexing means for each of the minute and second wheels. Both pawls could, for example, be tongues protruding from one and the same sheet metal member, if the two pawls, the minute wheel and the second wheel are so designed and mounted relative to one another that when the indexing means is indexed to a greater extent by way of the minute pulses, the pawl for the second wheel moves out into the void after the latter has been indexed one tooth. Another possibility would consist in providing the second and minute wheels with differing tooth sizes and tooth pitches. It is, however, most expedient for the part of the minute wheel pawl which cooperates with the minute wheel to be spaced at a smaller distance from the axis of the indexing means than the part of the second wheel pawl which cooperates with the second wheel, for it can then be readily arranged so that the path of the minute wheel pawl during deflection of the indexing means by the time pulses weaker in energy is not sufficient to index the minute wheel. The second wheel can then be of correspondingly small design, making it readily possible for it be be included in the watch movement described in German Offenlegungsschrift No. 2,617,077 and U.S. Pat. No. 4,128,992.

DRAWINGS

Further features, details and advantages of the invention are to be found in the enclosed drawings and following description of a preferred embodiment of an analog watch according to the invention. This is a battery driven wristwatch.

DESCRIPTION OF THE PREFERRED EMBODIMENT

Figure 1:
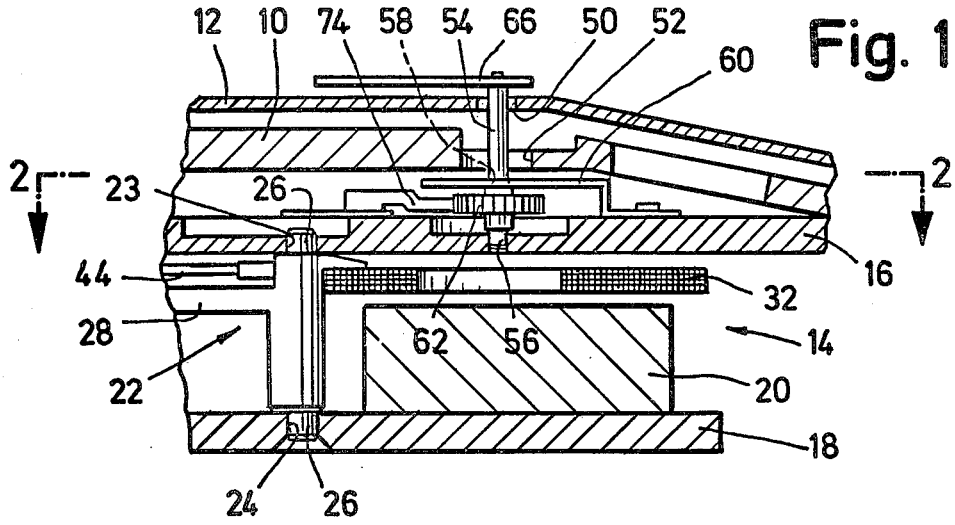
FIG. 1 is a section through part of this watch, taken along a line perpendicular to its dial.
Figure 2:
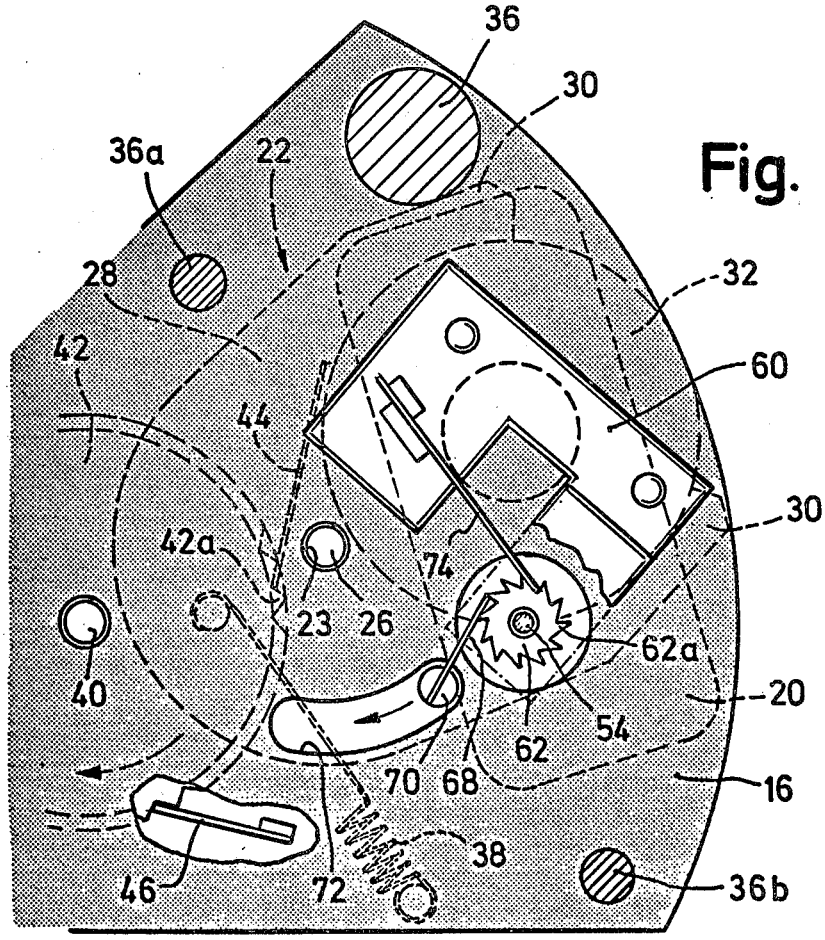
FIG. 2 is a section along line 2—2 of FIG. 1.

As is evident from FIGS. 1 and 2, the watch comprises as supporting member a front plate 10 to which a dial 12 is secured. On its rear side the front plate 10 carries the "motor" of the watch according to the invention which is designated in it entirety 14 and includes two spaced ferro-magnetic shunt plates 16 and 18, a permanent magnet 20 secured to the shunt plate 18 and an indexing means designated in its entirety 22. Like those widely used in electric wristwatches, the permanent magnet is an elongate magnet which has on each of its main surfaces an adjacent north and south pole and is polarized vertically relative to the plane of the shunt plates.

Bearing pins 26 of the indexing means 22 which are molded to a plate-shaped plastic member 28 are mounted for rotation in bearing bores 23 and 24 of the shunt plates. The plastic member comprises two arcuate arms 30 surrounding a drive coil 32 which is adhered to the plastic member 28. FIG. 2 shows the indexing means 22 in its position of rest, in which it abuts a pillar 36, and in which it is held by a return spring 38 mounted on the shunt plate 18. The pillar 36 and also pillars **36*a* and 36*b* serve to secure the shunt plate 16 and thus the entire motor to the front plate 10**.

The two shunt plates 16 and 18 also are provided with bearing bores (not shown) for an axle 40 of a minute wheel 42 which is mounted between the two shunt plates. In order to index the minute wheel a first pawl 44 which is in the form of a leaf spring and is secured to the plastic member 28 slides, upon pivotal movement of the indexing movement of the indexing means 22 in a clockwise direction, beyond one of the teeth **42*a* on the minute wheel 42, and, when the indexing means 22 is swung back by the return spring 38, indexes the minute wheel by one tooth, so that the minute wheel rotates in a clockwise direction as indicated in FIG. 2. The minute wheel 42 is prevented from rotating back by an arresting spring 46 secured to the shunt plate 18**.

Dial 12 and front plate 10 each have one aperture 50 and 52, respectively, for receiving a "second" wheel axle 54 which is mounted for rotation in a bearing bore 56 of the shunt plate 16 and a hole 58 in an angular sheet metal member 60 secured to the shunt plate 16. A toothed wheel 62 which comprises twelve teeth **62*a* and is secured to the second wheel axle is to be referred to hereinafter as second wheel although it is only indexed every five seconds, as will be explained in the following. A second hand 66 is secured to the second wheel axle 54**.

A second pawl 68 which is likewise in the form of a leaf spring and is carried by a pin 70 forming an integral part of the plastic member 28 serves to index the second wheel. For pin 70, the shunt plate 16 comprises an elongated curved aperture 72 which enables deflection of the indexing means 22. An arresting spring 74 secured to the angular sheet metal member 60 engages the teeth **62*a* of the second wheel. The second wheel 62 is not indexed when the indexing means 22 is deflected from its position of rest and the return spring 38 is tensioned, but rather when the indexing means is pivoted back under the influence of the return spring 38**.

Figure 3:
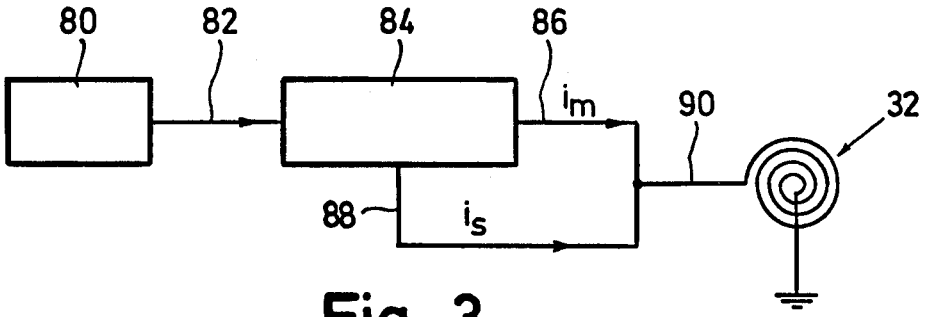
FIG. 3 is a block diagram of the circuit of the watch.
Figure 4:
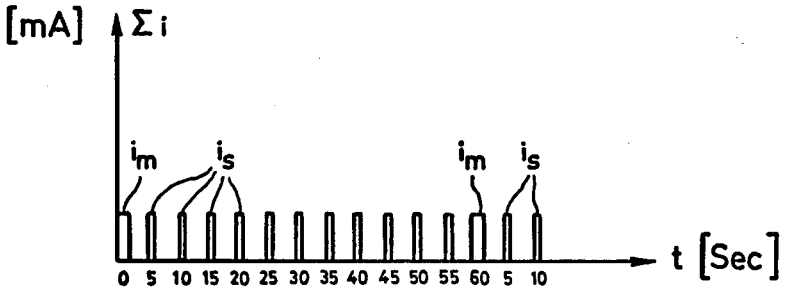
FIG. 4 is a diagram of the electrical pulses indexing the movement of the watch.

As is apparent from FIG. 3, the watch comprises a quartz oscillator 80 which delivers a pulse series of relatively high, but very precisely constant pulse series frequency through a line 82 to a multi-state frequency divider 84, which is simultaneously a pulse shaper. A series of minute pulses $i_m$ with a one minute time interval between their pulse leading edge is tapped off through a line 86 at an output of a suitable stage of the frequency divider 84. Pulses $i_s$ with a smaller time interval between their pulse leading edges, more particularly, an interval of five seconds, are tapped off at the output of a preceding stage of the frequency divider 84 through a line 88, and synchronized by conventional techniques so that they arrive at spaced time intervals as shown in FIG. 4. As is evident from FIG. 4, all the output pulses $i_s$ and $i_m$ are of the same pulse height, but the "other pulses" $i_s$ are shorter than the minute pulses $i_m$. In a preferred embodiment of the watch according to the invention, the pulse duration of the other pulses $i_s$ is only 4 msecs. As is apparent from FIG. 3, the pulses $i_s$ and $i_m$ are connected through a line 90 to one end of the coil 32 whose other end is connected to common or ground. For this purpose, the ends of the winding of the coil 32 which are not illustrated in FIGS. 1 and 2 can be wound around one of the bearing pins 26 of the indexing means 22 and then connected to two connecting means of an integrated circuit in the manner described in German Offenlegungsschrift No. 2,617,077.

The coil 32 is now poled and the permanent magnet 20 positioned such that the indexing means 22 is pivoted in a clockwise direction out of its position of rest, as shown in FIG. 2, by each of the pulses $i_m$ and $i_s$, more specifically, by only approximately 7° to a first indexing position by the other pulses $i_s$, which are weaker in energy, while the minute pulses $i_m$, which exhibit greater energy and have a pulse duration of, for example, 17 msecs cause the indexing means 22 to be deflected by approximately 40° to a greater of second indexing position. The operative areas of the leaf springs constituting the pawls 44 and 68 are mounted so differently with respect to the axis of rotation (staff 26) of the indexing means 22 so that when the indexing means 22 is deflected by only 7°, the second wheel 62 is indexed by one tooth. On the other hand, the indexing means requires a deflection of 25° in order to index the minute wheel 42. Accordingly, eleven small pulses $i_s$ index only the second hand 66, while the twelfth pulse $i_m$ indexes both the second hand 66 and simultaneously the minute hand (not shown) which is driven by minute wheel 42.

While there has been described what is considered to be the preferred embodiment of the invention, it is of course understood that various other modifications may be made therein, and it is intended to cover in the appended claims all such modifications as fall within the true spirit and scope of the invention.

We claim:

1. In a quartz controlled analog watch having a quartz controlled pulse generator for delivering minute pulses and an indexing means mounted for rotation about an axis and for directly driving a minute wheel through the intermediary of an indexing device, the indexing means being adapted to be deflected from a position of rest by means of a coil to which output pulses from said pulse generator have been applied, and a permanent magnet, one of said coil or said magnet being stationarily mounted and the other mounted on the indexing means, and having a return spring, the improvement comprising:

circuit means in said pulse generator adapted to deliver minute pulses ($i_m$) and other time pulses ($i_s$) weaker in energy than said minute pulses, the pulse series frequency of said other time pulses being 1/n Hz where n is an integer less than 60.

means coupling said minute pulses and said other pulses to said coil, whereby the indexing means is deflected by said other time pulses ($i_s$) from its position of rest to a first indexing position and beyond that by the minute pulses ($i_m$); to a second indexing position, a second wheel having a second hand and adapted to be driven by the indexing means to index the second wheel at the first indexing position, and, said indexing means being arranged only to index the minute wheel when it is deflected to the second indexing position by the minute pulse $i_m$.

2. The improvement as set forth in claim 1, wherein the indexing means is provided with a pair of pawls mounted thereon and said pawls having parts cooperating separately with said second wheel and minute wheel.

3. The improvement as set forth in claim 2, wherein the part of the minute wheel pawl cooperating with the minute wheel is spaced at a smaller distance from the axis of the indexing means than the part of the second wheel pawl cooperating with the second wheel.

4. The improvement as set forth in claim 2 or claim 3, wherein said pawls are resilient arms.

5. The improvement as set forth in claim 1, wherein the number of teeth on the second wheel is equivalent to 60/n.

* * * * *